United States Patent [19]

Dudzik

[11] Patent Number: 4,606,474

[45] Date of Patent: Aug. 19, 1986

[54] CONTAINER WITH PLUG-FITTING LID

[75] Inventor: Henryk Dudzik, Mansfield, England

[73] Assignee: Mardon Illingworth Limited, Nottinghamshire, England

[21] Appl. No.: 807,166

[22] Filed: Dec. 9, 1985

[30] Foreign Application Priority Data

Dec. 19, 1984 [GB] United Kingdom ..... 8431993

[51] Int. Cl.[4] ..... B65D 39/00

[52] U.S. Cl. ..... 220/307; 150/55

[58] Field of Search ..... 220/306, 307, 354, DIG. 19; 150/55

[56] References Cited

U.S. PATENT DOCUMENTS 4,397,404 8/1983 Blanchette ..... 220/307

4,458,825 7/1984 Holota ..... 220/307

FOREIGN PATENT DOCUMENTS 2131775A 6/1984 United Kingdom ..... 220/307

*Primary Examiner*—George T. Hall

*Attorney, Agent, or Firm*—Thomas & Kennedy

[57] ABSTRACT

A container having a body (10) provided with a mouth (14) defined by a lip (13) located radially inwardly of the main body wall (11) by a flange (12), and a lid having a skirt (23) for plug-fitting in the lip and a peripheral rim (24) projecting outwardly of the skirt so as to extend over the flange and permitting removal of the lid by a tool engaged between the rim and the flange, both the lid and the body being plastics mouldings wherein the surface (16) of the lip (13) engageable with the lid skirt (23) is convex in cross-section and in that the skirt has a complementary surface (28) which is concave in cross-section and extends from adjacent the rim (24).

13 Claims, 3 Drawing Figures

CONTAINER WITH PLUG-FITTING LID

FIELD OF THE INVENTION

This invention relates to a container with a plugfitting lid.

BACKGROUND OF THE INVENTION

Containers for paint have until recently been made of sheet metal. The container body has an inwardly directed peripheral flange at the rim with a downturned skirt located axially within the main peripheral wall of the body. The lid has a top provided with a skirt which is a tight interference fit in the skirt of the body due to the resilient deformation of the skirts. The skirt of the lid has an outwardly directed peripheral flange which seats on the body flange. The flanges are shaped to permit entry of a tool for levering off the lid from the body.

Paint containers are now being made of plastics material and problems are being met with providing a sufficiently tight fit of the lid in the body to provide a good seal whilst enabling the lid to be removed without damage to the lid, so that the body can be resealed. It is not possible for the lid to be a simple interference fit in the body in the manner of a metal container, because with a sufficiently tough plastics material to meet other requirements, the lid is likely to be ejected from the body due to the pressure exerted by hot paint in the container, or, after cooling, if pressure is applied to the body wall. In addition the sealing area is not sufficient. If the axial lengths of the lid and body skirts are substantially increased to increase the sealing area and provide a firmer hold of the lid in the body, then it is difficult to engage the lid, because the piston effect compresses air in the body as the lid is inserted so that there is a tendency for the lid to be blown off or for the seal to the forced open. Vents have been proposed to solve this problem, as disclosed in GB-A-2111470, but this introduces the risk of air entering the can and allowing polymerisation of the contents. No. EP-A-0112691 also discloses the provision of vents, the arrangement being that the vents are open as the lid is inserted, but are closed as the lid moves into the fully inserted position.

These problems are also discussed in No. GB-A-2111469 and, in this document, an attempt is made, by means of circumferential vanes, to increase the resistance to radial resilient deformation of the lid skirt to reduce the risk of opening of the seal between the lid and the body, whilst also providing vents to prevent pressurisation of the interior of the container.

U.S. Pat. No. 4,227,625 also provides a different form of circumferential vane for resisting opening of the seal between the lid and the body. This document does not provide vents, but provides a substantial circumferential lip within the body and a complementary formation on the lid to reduce the risk of the lid being blown out of engagement by the internal pressure.

SUMMARY OF THE INVENTION

The present invention permits the lid to be of exceptionally shallow depth whilst providing a good and effective seal between the lid and the container. The design is such that only a very short piston movement occurs when the lid is inserted, so that the provision of vents is not necessary. Furthermore, the present invention avoids the necessity for providing supporting vanes and permits a very simple design, which can easily be moulded.

The lids are usually stacked in a magazine for automatic feed to apparatus for fitting the lids to filled containers. The shallow depth of the lids of this invention, permits substantially more lids to be stacked in a magazine.

In accordance with this invention, there is provided a container having a body provided with a mouth defined by a lip located radially inwardly of the main body wall by a flange, and a lid having a skirt for plug-fitting in the lip and a peripheral rim projecting outwardly of the skirt so as to extend over the flange and permitting removal of the lid by means of a tool, both the lid and the body being plastics mouldings, the surface of the lip engageable with the lid skirt being convex in cross-section and the skirt having a complementary surface which is concave in cross-section and extends from adjacent the rim.

This arrangement means that the lid snap-engages into position as the bottom of the skirt passes the narrowest diameter of the lip and this positive engagement provides a tight seal. The arcuate engaging surfaces provide, in addition, a large sealing area over a short axial distance and this permits the skirt to be of shallow depth, so that the "piston effect" becomes negligible.

BRIEF DESCRIPTION OF THE DRAWINGS

Reference is now made to the accompanying drawing, wherein.

DETAILED DESCRIPTION

Figure 1:
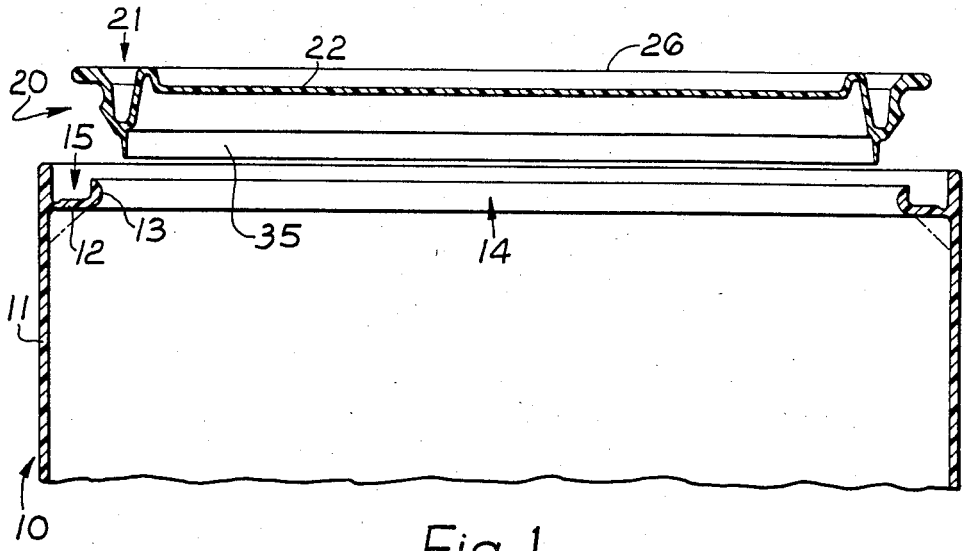
FIG. 1 is a cross-sectional view of a container according to the invention comprising a lid and a body with the lid disengaged.
Figure 2:
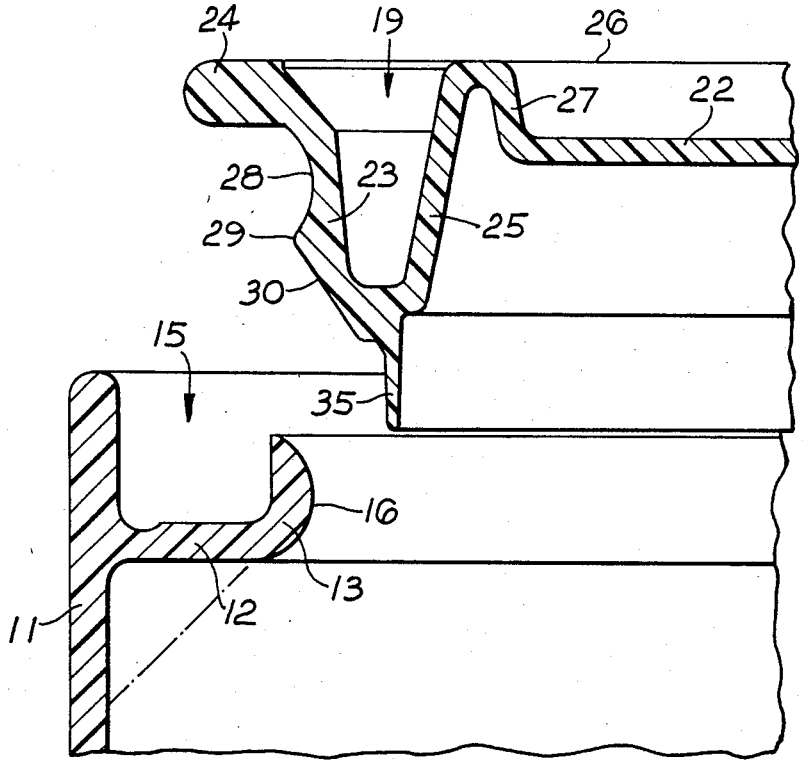
FIG. 2 is an enlarged view of a portion of FIG. 1.

The container comprises a body 10 and a lid 20, both of which are injection moulded from polypropylene.

The body has a cylindrical side wall 11 provided near its top, open end with an internally projecting annular flange 12, which carries an annular lip 13 defining the mouth 14 of the body and also defining a drip channel 15 around the mouth.

Figure 3:
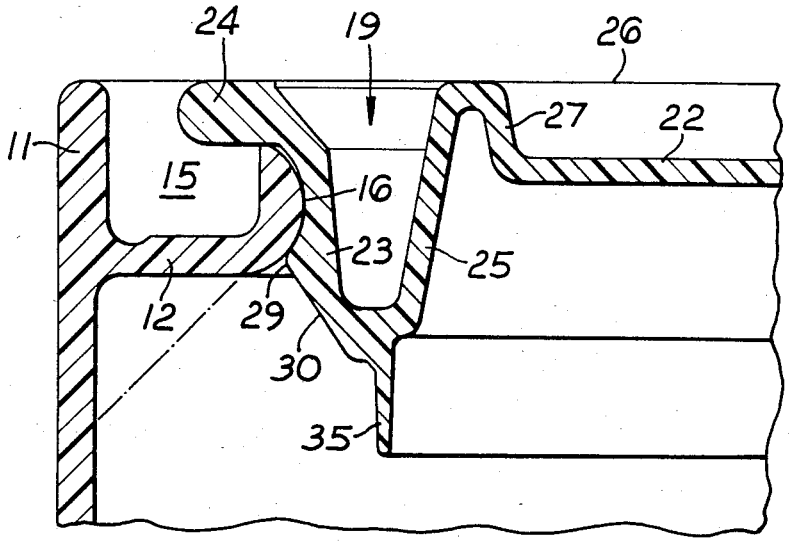
FIG. 3 is a view similar to FIG. 2 showing the lid engaged in the body.

The lid 20 comprises an annular peripheral part 21 surrounding a flat disc-shaped part 22, which is depressed relative to the plane 26 of the top of the peripheral part. The peripheral part 21 has a skirt 23 for plug-fitting in the lip 13 of the body. An outwardly projecting peripheral rim 24 extends from the skirt and projects (FIG. 3) partly over the drip channel 15. The top of the rim is in the same plane 26 as the top of the cylindrical wall 11 with the lid fitted in the body. The bottom of the skirt 23 is joined to an inner wall 25 which extends to the plane 26 and a connecting wall 27 joins the top of this inner wall to the disc-shaped part 22. An annular groove 19 is defined between the skirt 23 and the inner wall 25, the groove being open to the top of the lid and tapering from the top to define a reducing cross-section. The resultant sinuous configuration is strong and provides a resilient bias urging the skirt 23 into tight engagement with the lip 13.

The lip 13 has an inner face 16 which is convex in cross-section and extends through an arc of about 100°. The bottom of this inner face 16 does not extend below the plane of the bottom of the flange 12 defining the bottom of the drip channel 15. It is envisaged that the arc may extend through an angle of 70° to 130°, but preferably from 90° to 100°. The concave surface 28 of the lid extends through the same angle. The axial extent of the concave surface is about 45% of that of the skirt as measured from the external axial end of the rim. This relative extent may be from 35 to 50%.

The lid skirt has an outer surface part 28, which is concave in cross-section and complementary to the convex surface 16 of the body lip. The concave surface part 28 terminates at the rim 24 and at an annular edge 29 defined between the part 28 and a bevel surface 30.

In use, to engage the lid in the body, the annular edge 29 of the skirt first engages with the lip inner surface 16. This engagement occurs at a location substantially within the depth of the lip, due to the convex shaping of the latter. Pressure on the lid causes resilient inward movement of the skirt so that the lid snaps into the engaged position shown in FIG. 3. The axial movement during engagement is very short, so that pressurisation of the contents of the container is negligible. The convex shaping of the lip also serves to lead the lid into engagement, which facilitates automatic engagement of the lid.

In the engaged position, the arcuate surfaces provide a large area of surface contact between the lid and the body, so that a very effective seal is provided in a short axial depth.

The lid can be removed by engagement of the tool in the drip channel 15 between the cylindrical wall 11 and the rim 24 of the lid and, again, the convex shaping of the lip serves to lead the lid out of engagement with the lip.

The annular projection defined by the skirt 23 and the inner wall 25 can nest in the groove 19 of an adjacent lid. A stack of lids can be formed in this manner in a magazine for automatic feed to a lid-fitting apparatus. This nesting ability together with the very shallow depth of the skirt 23 means that an exceptionally high number of lids can be stacked in the magazine.

The bottom of the lid is formed with an annular projection 35 concentric with the skirt 23. The diameter of the projection is less than the smallest diameter of the skirt and the projection has no effect with respect to the sealing of the lid in the body. The projection serves as a locating member for automatic positioning of the lid on the body after it is fed from the magazine. The projection ensures that the lid cannot be dislodged from the body by automatic machinery which pushes the lid into place. The projection seats in the groove 19 of an adjacent lid when stacked in a magazine so also has no effect on the number of lids that can be stacked in the magazine. The projection can be omitted where there is no risk of dislodgement of the lid from the body by the lid-engaging machinery.

I claim:

1. A container comprising a plastics moulded body and a plastics moulded lid;

(i) the body comprising a cylindrical main wall, a bottom closing one end of the main well, an inwardly directed peripheral flange adjacent the opposite end of the main wall and spaced from said opposite end, and a peripheral lip integral with the flange, the lip having an inner surface defining a mouth of the body and an outer surface defining a peripheral channel with the flange and the main wall, said inner surface of the lip being convex in cross-section;

(ii) the lid comprising a main closure portion, a skirt integrally connected with the main closure portion and surrounding the latter and a peripheral rim projecting outwardly of the skirt, said skirt having an outer peripheral surface which is concave in cross-section and extends adjacent said rim, said outer peripheral surface being complementary to the peripheral inner surface of said lip of the body;

(iii) whereby said skirt can be snap-fitted into firm, sealing, plug-fitting engagement in said lip with said rim of the lid extending over said flange of the body so that a tool can be fitted between said flange and said rim to lever off the lid.

2. A container according to claim 1, wherein said skirt of the lid comprises a lead-in conical surface at the opposite axial side of said outer peripheral concave surface to said rim.

3. A container according to claim 1, including an inner annular wall encircling said main closure portion of the lid and integrally connected thereto, said skirt being integrally connected to said inner annular wall and encircling the latter so as to define a groove between said inner annular wall and said skirt, said groove being open to the exterior side of the container, whereby the skirt of another identical lid can be nested in said groove.

4. A container according to claim 3, comprising an additional annular wall located between and integrally connected to said inner annular wall and said main closure portion, said additional annular wall being axially shorter than said inner annular wall, whereby a groove is defined between said inner annular wall and said additional annular wall, said groove being open to the interior of the container, said skirt, inner annular wall and outer annular wall together defining in cross-section a sinuous curve.

5. A container according to claim 1, wherein the flange of the body joins the lip at the inner axial end of the lip.

6. A container according to claim 1, wherein the concave surface of the lid extends as viewed in cross-section through an arc of 70° to 130°.

7. A container according to claim 6, wherein said arc is 90° to 110°.

8. A container according to claim 7, wherein said arc is about 100°.

9. A container according to claim 7, wherein the axial extent of said concave surface is 35 to 50% of the axial extent of said skirt measured from the axially outermost surface of said rim.

10. A container according to claim 8, wherein said axial extent of said concave surface is about 45% of that of said skirt.

11. A container according to claim 3, wherein the concave surface of the lid extends as viewed in cross-section through an arc of 90° to 110° and the axial extent of said concave surface is 35 to 50% of the axial extent of said skirt measured from the axially outermost surface of said rim.

12. A container according to claim 1, wherein the body and the lid are moulded from polypropylene.

13. A lid for plug-fitting in a container body, said body being moulded in one piece from a plastics material and comprising a main closure portion, a skirt integrally connected with the main closure portion and surrounding the latter and a peripheral rim projecting outwardly of the skirt, said skirt having an outer peripheral surface which is concave in cross-section and extends adjacent said rim, said outer peripheral surface being complementary to the peripheral inner surface of said lip of the body; whereby said skirt can be snap-fitted into plug-fitting engagement with a complementary formation in the mouth of a container body, said lid including an inner annular wall encircling said main closure portion of the lid and integrally connected thereto, said skirt being integrally connected to said inner annular wall and encircling the latter so as to define a groove between said inner annular wall and said skirt, said groove being open to the exterior side of the container, whereby the skirt of another identical lid can be nested in said groove.

* * * * *